US006837491B2

(12) United States Patent
Becker et al.

(10) Patent No.: US 6,837,491 B2
(45) Date of Patent: Jan. 4, 2005

(54) DEVICE FOR SUSTAINING A CONTACT FORCE OF A CONTROL ROLLER ON A CONTROL CAM APPERTAINING THERETO

(75) Inventors: Willi Becker, Bammental (DE); Andreas Fricke, Eberbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 24 days.

(21) Appl. No.: 10/340,988

(22) Filed: Jan. 13, 2003

(65) Prior Publication Data

US 2003/0132573 A1 Jul. 17, 2003

(30) Foreign Application Priority Data

Jan. 11, 2002 (DE) ..... 102 01 030

(51) Int. Cl.[7] ..... B65H 29/04
(52) U.S. Cl. ..... 271/204
(58) Field of Search ..... 221/247, 249, 221/251, 268, 277, 204, 206, 82, 85, 3.24, 228

(56) References Cited

U.S. PATENT DOCUMENTS

| | | | | |
|---|---|---|---|---|
| 2,846,947 A | | 8/1958 | Rodenhausen | |
| 3,443,808 A | | 5/1969 | Siebke | |
| 4,583,728 A | * | 4/1986 | Mathes | 271/268 |
| 4,928,586 A | * | 5/1990 | Kida | 101/230 |
| 4,993,275 A | * | 2/1991 | Pollich et al. | 74/54 |
| 5,813,338 A | * | 9/1998 | Kojima et al. | 101/231 |

FOREIGN PATENT DOCUMENTS

| | | |
|---|---|---|
| DD | 241 580 A1 | 10/1985 |
| DE | 934 770 | 11/1955 |
| DE | 1 611 240 | 4/1972 |
| DE | 37 36 808 C2 | 9/1988 |
| EP | 0 908 314 A1 | 4/1999 |
| EP | 0 841 161 B1 | 11/2001 |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Gregory L. Mayback

(57) ABSTRACT

A device for preventing a spring-loaded control roller from being lifted off a control cam therefor in a gripper control system in a sheet processing machine, includes a support mechanism disposed separately from the gripper control system. The support mechanism impresses an additional force upon the control roller in critical regions.

16 Claims, 4 Drawing Sheets

DEVICE FOR SUSTAINING A CONTACT FORCE OF A CONTROL ROLLER ON A CONTROL CAM APPERTAINING THERETO

BACKGROUND OF THE INVENTION

Field of the Invention

The invention relates to a device for sustaining a contact force of a control roller against a control cam appertaining thereto.

When mechanically controlled grippers are installed on sheet guiding cylinders in printing presses, it is conventional for the grippers and gripper mechanisms, which are disposed on the sheet-guiding cylinders, such as impression cylinders, transfer cylinders, turning or reversing cylinders, storage cylinders, feed cylinders, and so forth, to be controlled cyclically by control rollers operating in conjunction with corresponding control cams. One or more spring elements ensure contact between the control rollers and the control cams. At high press speeds, the control rollers tend to lift away or jump from the control cams.

German Patent 1 611 240 describes how to prevent jumping of the control rollers by providing forced control with inner and outer cams. Such devices are difficult to assemble and exhibit incorrectable play between the inner cam and the control roller, and between the control roller and the outer cam.

European Patent Application EP 0 908 314 A1 describes a device wherein a spring, which is provided for pressing the control roller against a control cam, acts upon the control roller via a torque transmission mechanism. Through the use of that feature, the spring force acting on the control roller is sought to be approximately equal at the high and low points. It is impossible, however, separately and independently to control the forces of the control roller at the high and low points.

SUMMARY OF THE INVENTION

It is accordingly an object of the invention to provide a device for sustaining a contact force of a control roller against a control cam appertaining thereto, which overcomes the hereinafore-mentioned disadvantages of the heretofore-known devices of this general type and which prevents the lifting of a control roller from a control cam, the contact forces of which in critical regions are individually adjustable.

With the foregoing and other objects in view, there is provided, in accordance with the invention, a device for preventing a spring-loaded control roller from being lifted off a control cam thereof in a gripper control system in a sheet processing machine. The device comprises a support mechanism disposed separately from the gripper control system for impressing an additional force upon the control roller in critical regions.

In accordance with another feature of the invention, the support mechanism includes two pivotably mounted levers, and a spring element having a spring force applied to the levers.

In accordance with a further feature of the invention, one of the levers carries a support roller. The other of the levers carries a further control roller.

In accordance with an added feature of the invention, the device further includes a further control cam. The further control roller is to be brought into active contact with the further control cam.

In accordance with an additional feature of the invention, the further control cam is displaceably disposed.

In accordance with yet another feature of the invention, the support roller is to be brought into active contact with an element of the gripper control system.

In accordance with yet a further feature of the invention, the device further includes an actuating element and a connection therefrom to a control unit of the sheet processing machine. The further control curve is remotely displaceable by the actuating element via the connection to the control device of the sheet processing machine.

In accordance with yet an added feature of the invention, the force of the spring element is adjustable.

In accordance with yet an additional feature of the invention, the gripper control system includes a torsion spring for generating a contact force between the control roller and the control cam.

In accordance with still another feature of the invention, the device further includes a control lever for the control roller. The control lever has a tooth connection for effecting a pivoting motion of a gripper shaft.

In accordance with still a further feature of the invention, the gripper control system further includes a helical spring for generating a pressure force between the control roller and the control cam.

In accordance with still an added feature of the invention, the control roller is disposed as a forerunning roller.

In accordance with still an additional feature of the invention, the control roller is disposed as a follower roller.

In accordance with another feature of the invention, the sheet processing machine is a printing press.

In accordance with a further feature of the invention, the support mechanism includes a pivotably mounted lever carrying a support roller for bringing the support roller into active contact with an element of the gripper control system.

In accordance with a concomitant feature of the invention, the element is a control lever formed with a control contour on a support surface cooperating with the support roller.

A particular advantage of the invention is that an additional contact force acts precisely in the critical region wherein the control roller tends to lift and not in other regions. In that way, it is possible to reduce the wear at the control roller and the control cam and to improve the service life or durability thereof.

A spring-loaded support mechanism cooperating with an additional control cam ensures a precise setting or application of the roller forces at the critical regions, for example when respectively opening and closing the grippers.

Other features which are considered as characteristic for the invention are set forth in the appended claims.

Although the invention is illustrated and described herein as embodied in a device for sustaining a contact force of a control roller against an appertaining control cam, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
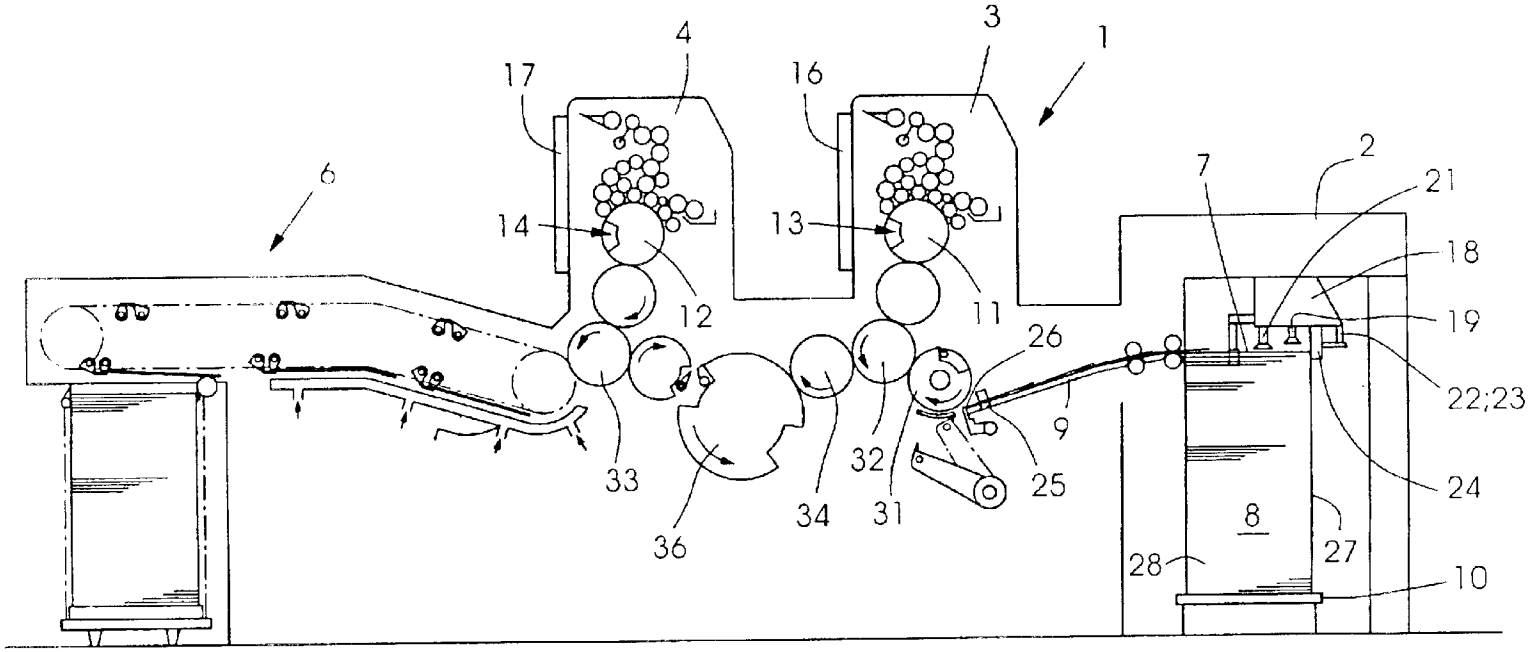
FIG. 1 is a diagrammatic, side-elevational view of a rotary printer wherein a roller control according to the invention may be embodied.

Referring now to the figures of the drawings in detail and first, particularly, to FIG. 1 thereof, there is seen a rotary printing press, for example a printing press 1 to which a sheet 7 is fed, including a feeder 2, at least one printing unit 3 or 4 and a delivery 6. The sheets 7 are removed from a sheet pile or stack 8 and fed to the printing units 3 and 4 individually or in a shingled formation by way of a feedboard or feed table 9. The printing units 3 and 4 include, in a conventional manner, plate cylinders 11 and 12, respectively. The respective plate cylinders 11 and 12 include a respective device 13 and 14 for fastening flexible printing plates thereon. Moreover, respective devices 16 and 17 for automatic or semi-automatic printing-plate exchange are allocated to the plate cylinders 11 and 12, respectively.

The sheet pile 8 lies on a controllably liftable pile or stack plate 10. Removal of the sheets 7 commences from the top of the pile 8 by a so-called suction head 18 which, among other things, has a number of lifting and dragging suckers 19 and 21 for singling or individually separating the sheets 7. Furthermore, blowing or blast devices 22 are provided for loosening the top sheet layers, and scanning or feeling elements 23 are provided for tracking or readjusting the sheet pile. A number of lateral and rear stops are provided for aligning the sheet pile 8, particularly the top sheet 7 of the sheet pile 8.

Any or all of the cylinders guiding the sheets and, therefore, carrying grippers, including a feed cylinder 31, impression cylinders 32 and 33, a transfer cylinder 34, a storage drum 36, and a reversing or turning drum 37, can be furnished with a support mechanism 38 according to the invention.

Figure 2:
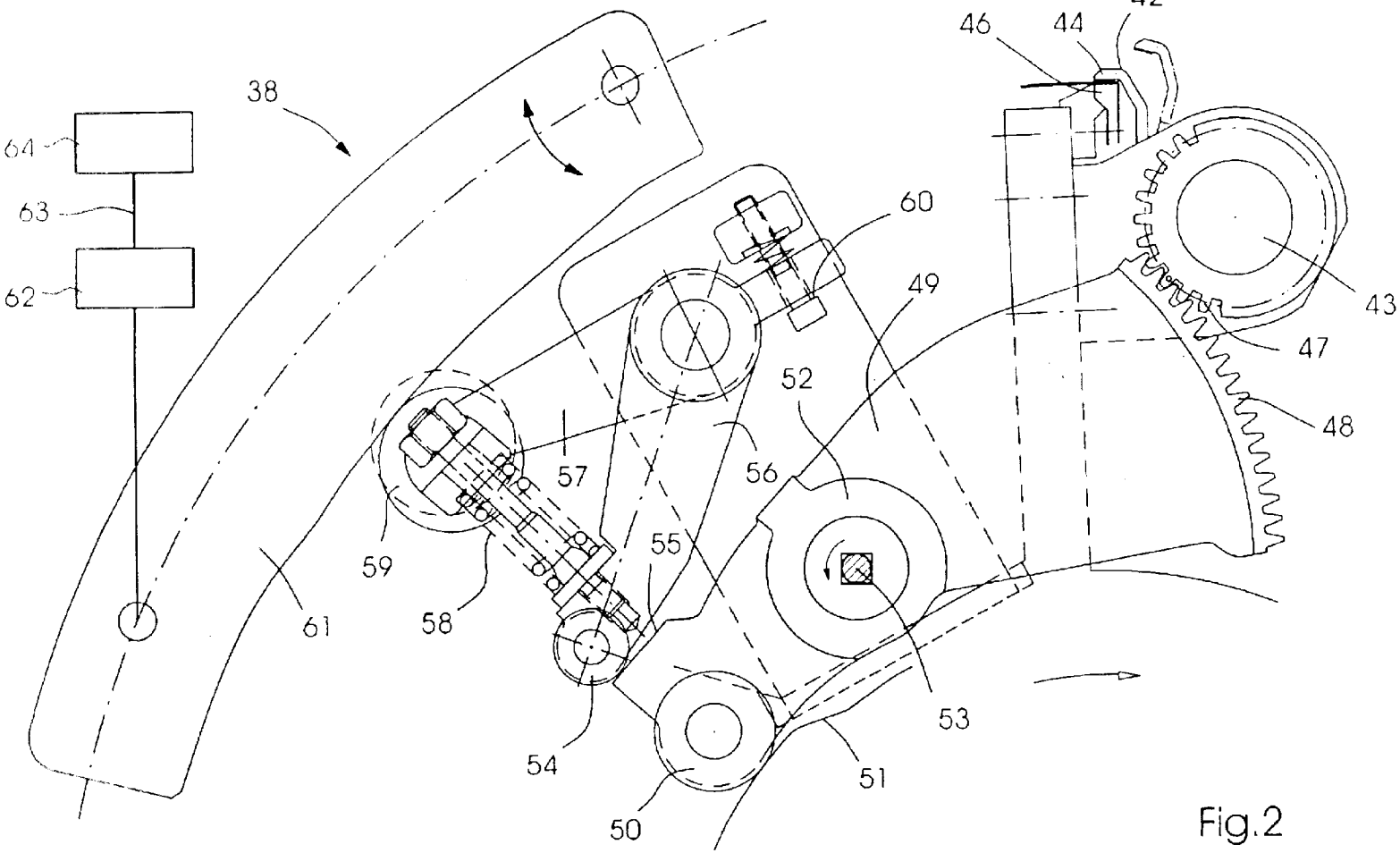
FIG. 2 is an elevational view of a first exemplary embodiment of the roller control according to the invention.

FIG. 2 illustrates the support mechanism 38 in the vicinity or region of the face of a respective cylinder carrying the grippers. At least one conventional gripper or pincers gripper 42 is disposed on a gripper shaft 43 which is pivotably mounted on the cylinder. A nose 44 of the gripper 42 works together with a gripper seat 46 for the purpose of transporting the sheet. The gripper shaft 43 has a gearwheel or first toothed segment 47 mounted thereon, the teeth of the gearwheel or toothed segment 47 meshing with a second toothed segment 48 which is disposed on the end of a control lever 49 pivotably mounted on the cylinder. A rotatably mounted control roller 50, which is disposed on the opposite end of the control lever 49, cooperates with a stationary control cam 51. A bearing location 52 for the control lever 49 has a torsion spring 53 which is constructed as a torsion bar spring and which ensures a minimum required pressure force of the control roller 50 on the control cam 51. In order to increase the supporting force up to a maximum required contact force, the control lever 49 is formed with a radially outwardly directed support surface 55 in the vicinity or region of the control roller 50, which can be brought into supportive contact with a support roller 54 of the support mechanism 38 in critical regions. The support roller 54 is rotatably mounted at the end of a first support lever 56, which is pivotably mounted on the cylinder. A second support lever 57 has the same mounting location on the cylinder as does the first support lever 56, and carries an adjustable prestressed compression spring 58 at the end thereof, which acts upon the first support lever 56 in the region of the support roller 54. Also disposed at the end of the second support lever 57 is a rotatably mounted control roller 59, which cooperates with a stationary control cam 61. The control cam 61 is disposed in critical regions, such as in the gripper opening region, for example. In this regard, the cam 61 acts with the control contour thereof upon the support roller 54 via the control roller 59, the support lever 57 and the spring 58, so that the support roller 54, being spring loaded, influences the support surface 55 of the control lever 49 and thereby increases the overall spring power resulting from the force of the torsion spring 53 and the spring 58. Due to these measures, the control roller 50 is prevented from being lifted off from the control cam 51. In order to modify the timing and the force, respectively, of the action of the support mechanism 38, the support cam 61 is pivotably mounted, and is remotely displaceable with the aid of an actuating element such as a motor 62 and connecting lines 63 to the control device or machine control unit 64 of the printing machine 1.

Outside the operating range or region of the control cam 61, the support roller 54 is separated from the support surface 55. In this region (approximately 330° machine angle), the support lever 57 abuts a stop 60, so that the control roller 50 is pressed against the control cam 51 with considerably less force. The service life thereof is thereby increased.

Figure 3:
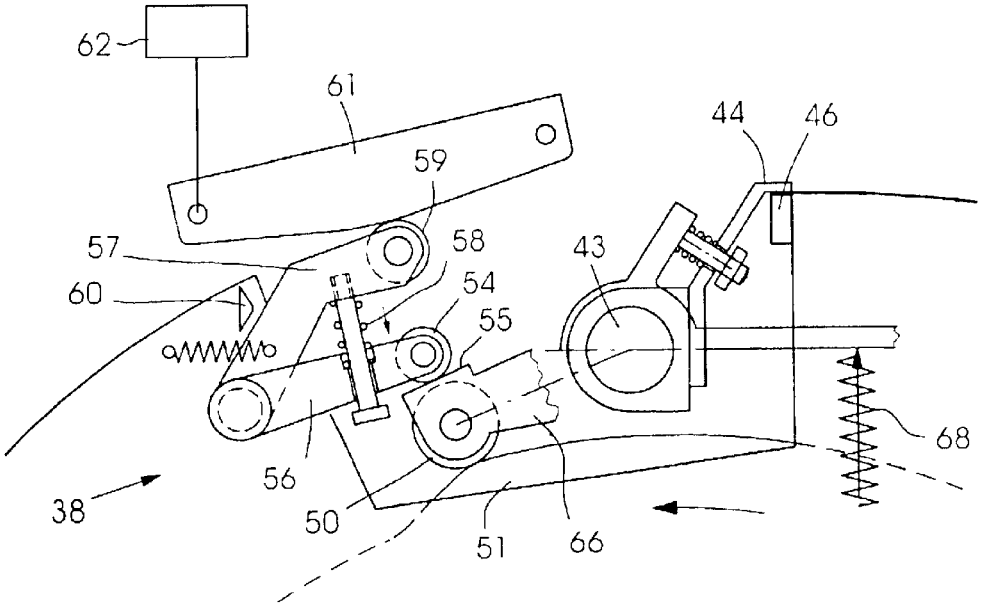
FIG. 3 is an elevational view of a second exemplary embodiment having a follower control roller.
Figure 4:
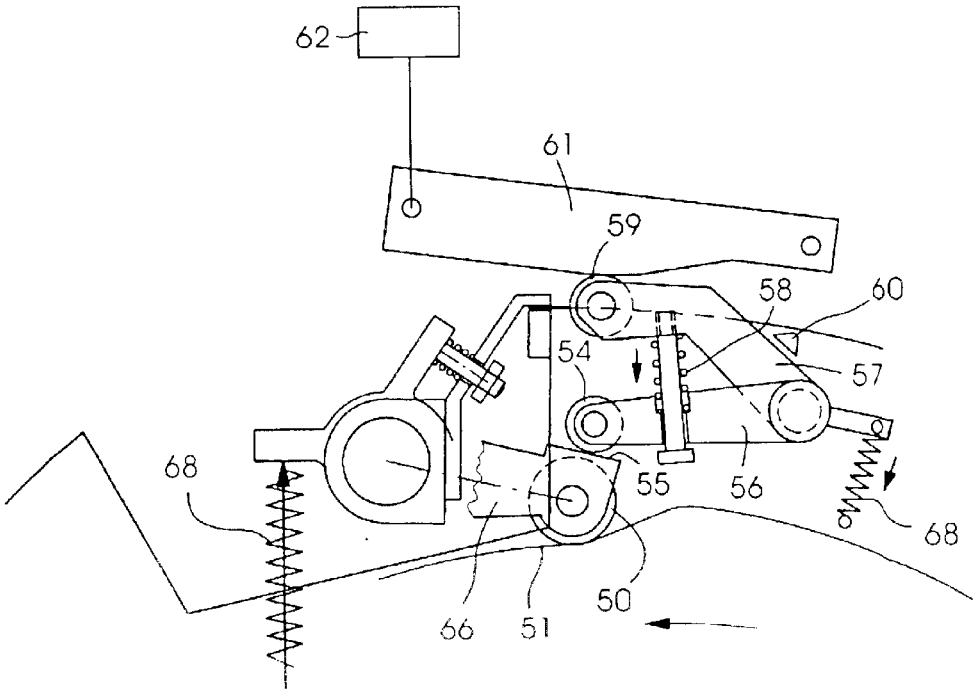
FIG. 4 is an elevational view of a third exemplary embodiment having a forerunning control roller.

In the second exemplifying embodiment according to FIG. 3, the gripper shaft 43 is pivotable by a double-armed lever or bell crank 66 which is fastened to the gripper shaft 43, and has a first arm carrying the rotatably mounted control roller 50, and a second arm holding a helical spring 68 which is fixed to the cylinder and is braced against the second arm.

In the region of the control roller 50 which cooperates with the control cam 51, a support surface 55 is formed on the lever 66 and cooperates with the support roller 54 of the support mechanism 38. The control roller 50 is disposed in front of, i.e., preceding, the gripper shaft 43 in the direction of cylinder rotation as a so-called forerunning roller. A spring-supported gripper opening process is thereby produced.

In a third exemplifying embodiment, the control roller 50 is constructed as a so-called follower roller. A spring-supported gripper closing process is thereby produced.

Figure 5:
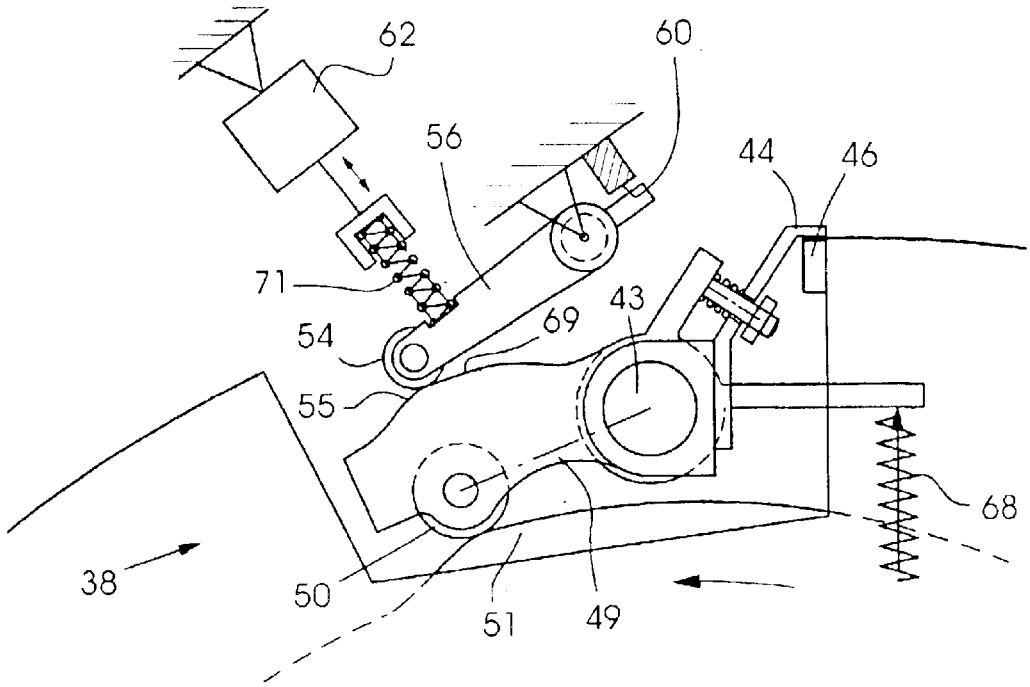
FIG. 5 is an elevational view of a fourth exemplary embodiment of the roller control according to the invention.

In a fourth exemplifying embodiment, as shown in FIG. 5, the support roller 54 is rotatably mounted on an end of the lever 56, and the other end of the lever located opposite the support roller 54 is pivotably mounted on the frame of the sheet-processing or printing machine 1. The support surface 55 of the control lever 49 has a control cam contour 69. A prestressed spring 71 acts upon the lever 56 from above and moves it against a stationary stop 60 and into a waiting or maintenance position. The force of the spring 71 is remotely adjustable by the printing-machine control via a stationary drive 62, for example, a servomotor. Upon the rotation of the gripper-carrying cylinder, the support roller 54 enters onto the active region of the control contour 69 applied to the control lever 49. The support roller 54 is displaced counter to the force of the spring 71 by the contour 69 of the support surface 55, so that the desired supporting force acts between the support roller 54 and the support surface 55, which prevents the control roller 50 from lifting off from the control cam 51. The support mechanism 38 described in the various exemplifying embodiments is always disposed in the region of an end face of the gripper-carrying cylinder, preferably between the end face of the cylinder and the side frame of the sheet processing or printing machine.

We claim:

1. In a sheet processing machine including a gripper control system having a spring-loaded control roller and a control cam therefor, a device for preventing the control roller from being lifted off the control cam, the device comprising:

a support mechanism disposed separately from the gripper control system for impressing an additional force upon the control roller in critical regions, said additional force being individually adjustable.

2. The device according to claim 1, wherein said support mechanism includes two pivotably mounted levers and a spring element having a spring force applied to said levers.

3. The device according to claim 2, wherein one of said levers carries a support roller, and the other of said levers carries a further control roller.

4. The device according to claim 3, further comprising a further control cam, said further control roller to be brought into active contact with said further control cam.

5. The device according to claim 4, wherein said further control cam is displaceably disposed.

6. The device according to claim 3, wherein said support roller is to be brought into active contact with an element of the gripper control system.

7. The device according to claim 6, further comprising a machine control unit, an actuating element, and a connection from said actuating element to said machine control unit, said actuating element remotely displacing said further control cam via said connection to said machine control unit.

8. The device according to claim 2, wherein said force of said spring element is adjustable.

9. The device according to claim 1, wherein the gripper control system includes a torsion spring for generating a contact force between the control roller and the control cam.

10. The device according to claim 1, further comprising a control lever for the control roller, said control lever having a tooth connection for effecting a pivoting motion of a gripper shaft.

11. The device according to claim 1, wherein the gripper control system further includes a helical spring for generating a pressure force between the control roller and the control cam.

12. The device according to claim 1, wherein the control roller is disposed as a forerunning roller.

13. The device according to claim 1, wherein the control roller is disposed as a follower roller.

14. The device according to claim 1, wherein the sheet processing machine is a printing press.

15. The device according to claim 1, wherein the support mechanism includes a pivotably mounted lever carrying a support roller for bringing said support roller into active contact with an element of the gripper control system.

16. The device according to claim 15, wherein said element is a control lever formed with a control contour on a support surface cooperating with said support roller.

* * * * *